US010743681B2

(12) United States Patent
Boehnen et al.

(10) Patent No.: US 10,743,681 B2
(45) Date of Patent: Aug. 18, 2020

(54) ARTICLE DIVIDER ASSEMBLY

(71) Applicant: LIBERTY HARDWARE MFG. CORP., Winston-Salem, NC (US)

(72) Inventors: Patrick William Boehnen, Summerfield, NC (US); Matthew James Klein, Apex, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 0 days.

(21) Appl. No.: 16/536,998

(22) Filed: Aug. 9, 2019

(65) Prior Publication Data

US 2019/0357703 A1 Nov. 28, 2019

Related U.S. Application Data

(60) Continuation of application No. 15/875,247, filed on Jan. 19, 2018, now Pat. No. 10,413,094, which is a (Continued)

(51) Int. Cl.
*A47F 7/00* (2006.01)
*A47F 5/08* (2006.01)

(Continued)

(52) U.S. Cl.
CPC ..... *A47F 7/0014* (2013.01); *A47F 5/08* (2013.01); *A47F 5/105* (2013.01); *A47F 7/0021* (2013.01);

(Continued)

(58) Field of Classification Search
CPC .. A47F 7/005; A47F 7/14; A47F 7/146; A47F 7/148; A47F 7/16; A47F 7/0042;

(Continued)

(56) References Cited

U.S. PATENT DOCUMENTS 475,948 A * 5/1892 Pease ..... A47F 7/0042 211/41.16
739,027 A * 9/1903 Raum ..... A47F 7/0042 211/41.16

(Continued)

FOREIGN PATENT DOCUMENTS

CA 2505163 A1 10/2006
CN 203175030 U 9/2013

(Continued)

OTHER PUBLICATIONS www.thermatru.com/trade-professional/doorgallerydisplays.aspx, "Door Gallery Displays", Jul. 10, 2010, 31 pages.

(Continued)

*Primary Examiner* — Jennifer E. Novosad
(74) *Attorney, Agent, or Firm* — Brooks Kushman P.C.; Lora Graentzdoerffer

(57) ABSTRACT

An article divider assembly is provided with a support bracket adapted to be mounted to a retail display. A divider member extends from the support bracket and is sized to extend between a pair of articles at an upper region of the pair of articles to divide the articles without blocking an outward face of the articles. The divider member comprises a proximal end mounted to the support bracket and a distal end extending away from the support bracket. A display bracket is mounted to the distal end of the divider member.

20 Claims, 7 Drawing Sheets

Related U.S. Application Data division of application No. 14/656,848, filed on Mar. 13, 2015, now Pat. No. 9,907,415.

(51) Int. Cl.
*A47F 7/14* (2006.01)
*A47F 5/10* (2006.01)
*A47F 5/00* (2006.01)

(52) U.S. Cl.
CPC ..... *A47F 7/0042* (2013.01); *A47F 7/146* (2013.01); *A47F 7/148* (2013.01); *A47F 2005/0075* (2013.01)

(58) Field of Classification Search
CPC .. A47F 5/00; A47F 5/0006; A47F 2005/0075; A47F 5/01; A47F 5/0846; A47F 5/0853; A47F 5/0876; A47F 5/105; A47F 5/13; A47F 7/281; A47B 81/00; A47B 81/005; A47B 57/58; A47B 55/02; A47B 96/06; A47B 81/007
USPC ..... 211/86.01, 41.15, 41.16, 44, 45, 94.01, 211/60.1, 49.1, 189, 175, 193, 57.1, 59.1, 211/59.4, 184, 87.01; 248/214, 250, 248/227.2, 227.1, 228.6, 231.71
See application file for complete search history.

(56) References Cited

U.S. PATENT DOCUMENTS 805,570 A * 11/1905 Maldaner ..... E06B 9/323 248/264
865,465 A * 9/1907 Williams ..... A47F 7/0042 211/41.16
949,915 A * 2/1910 Schreiber ..... A47F 7/0042 211/41.16
D43,274 S * 11/1912 Goodwin ..... D6/349
1,242,872 A * 10/1917 Saunders ..... A47F 9/04 52/33
1,530,211 A * 3/1925 Siemnash ..... A63C 17/18 280/7.13
1,688,255 A * 10/1928 Wasch ..... A47F 7/0042 211/41.16
1,714,692 A * 5/1929 Pagel ..... B65D 71/04 206/451
1,736,828 A * 11/1929 Lobban ..... A47F 7/163 211/41.16
1,841,620 A * 1/1932 Mccoy ..... G09F 5/04 312/234
1,927,837 A * 9/1933 Kingdon ..... A47F 7/0042 312/237
2,113,288 A * 4/1938 Berger ..... B65D 5/4204 229/107
2,223,770 A * 12/1940 Nagle ..... B65D 5/4204 493/102
D129,731 S * 9/1941 Luttrell ..... D9/418
2,290,104 A * 7/1942 Larson ..... B65D 5/4204 206/565
2,501,609 A * 3/1950 Midouhas ..... B65D 5/5021 206/449
D165,358 S * 12/1951 Baldwin ..... D6/678.4
D174,553 S * 4/1955 Harris ..... D6/679
2,879,899 A * 3/1959 Shenkin ..... A47F 5/0823 211/55
2,884,136 A * 4/1959 Leighton ..... B65G 49/062 211/41.14
2,887,219 A * 5/1959 Lester, Jr. ..... E06B 7/00 206/325
2,937,743 A * 5/1960 Buttery ..... B65D 5/5007 206/783
2,944,679 A * 7/1960 Rubenstein ..... A47F 5/01 211/133.5
2,950,001 A * 8/1960 Bucko ..... B65D 85/48 206/454
3,033,356 A * 5/1962 Meyerson ..... B65D 5/4204 206/446
3,095,970 A * 7/1963 Gaulke ..... B65D 5/505 206/453
3,108,657 A * 10/1963 Carlson ..... E04G 1/24 182/119
3,121,511 A * 2/1964 Whitehead ..... B65D 83/00 221/283
3,175,694 A * 3/1965 Reibold ..... A47F 7/0021 211/60.1
D202,485 S * 10/1965 Fletcher ..... D6/683.1
3,233,753 A * 2/1966 Rich ..... B65D 85/48 280/47.18
3,347,357 A * 10/1967 De Soto ..... B65D 5/52 229/112
3,359,573 A * 12/1967 Casebolt ..... E06B 3/4681 4/607
3,361,330 A * 1/1968 Arneson ..... B65D 5/5007 206/591
3,385,451 A * 5/1968 Anderson ..... A47F 7/0021 211/60.1
D211,321 S * 6/1968 Ullmann ..... D9/418
3,388,787 A * 6/1968 Growney ..... B65D 5/5002 206/783
3,403,777 A * 10/1968 Bucko ..... B65D 85/48 206/454
3,468,593 A * 9/1969 Catlett ..... A47F 7/166 312/234
3,517,459 A * 6/1970 Schupper ..... E05D 15/0665 49/425
3,517,801 A * 6/1970 Cote ..... B65D 5/5016 206/779
D224,692 S * 8/1972 Gray ..... D6/517
3,732,633 A * 5/1973 Margolis ..... A47F 7/0042 211/162
D227,351 S * 6/1973 Winton ..... D9/418
3,777,883 A * 12/1973 Hackenberg ..... B65D 5/10 206/780
3,777,896 A * 12/1973 Ehrlich ..... A47F 5/0037 211/59.2
3,889,813 A * 6/1975 Wright ..... A47F 5/01 211/41.15
3,935,949 A * 2/1976 Cohen ..... A47F 5/01 211/168
D240,503 S * 7/1976 Crescenzi ..... D8/375
4,105,125 A * 8/1978 Magness ..... A47F 7/0021 211/13.1
4,109,786 A * 8/1978 Roccaforte ..... B65D 5/5007 206/783
4,145,849 A * 3/1979 Shindoll ..... A47B 96/00 108/187
4,241,832 A * 12/1980 Bliss ..... B65D 81/05 206/523
4,256,043 A * 3/1981 Ovitz, III ..... A47F 7/163 108/29
D259,161 S * 5/1981 Thauer ..... D6/675.2
4,315,569 A * 2/1982 Jaeschke ..... B65D 5/4204 206/304
4,342,268 A * 8/1982 Grava ..... B65D 85/62 108/55.1
4,378,905 A * 4/1983 Roccaforte ..... B65D 5/46152 229/117.12
4,385,687 A * 5/1983 Dutcher ..... B65D 5/5009 206/521
4,429,791 A * 2/1984 Ruppel ..... B65D 85/48 206/453
4,520,978 A * 6/1985 Taub ..... A47F 5/0823 211/57.1
4,634,010 A * 1/1987 Otema ..... A47F 7/24 211/103
4,705,175 A * 11/1987 Howard ..... A47F 5/103 108/109
4,720,876 A * 1/1988 Tomei ..... A47K 3/36 4/600

(56) References Cited

U.S. PATENT DOCUMENTS 4,750,609 A * 6/1988 Felis ..... A45C 7/00 206/1.7
4,762,235 A * 8/1988 Howard ..... A47B 57/46 108/109
5,031,781 A * 7/1991 Price ..... A47F 7/163 211/128.1
D319,934 S * 9/1991 Terrell ..... D6/675.1
D323,986 S * 2/1992 Ferrero ..... D9/418
5,111,943 A * 5/1992 Ramey ..... G09F 7/00 211/59.4
D332,744 S * 1/1993 McCooey ..... D9/415
5,234,113 A * 8/1993 Ramey ..... G09F 7/00 211/41.15
D343,075 S * 1/1994 Cappel, III ..... D6/678.4
5,297,685 A * 3/1994 Ramey ..... G09F 7/00 211/41.15
5,305,898 A * 4/1994 Merl ..... A47F 5/0807 211/103
D349,458 S * 8/1994 Verdaguer ..... D9/415
5,346,076 A * 9/1994 Hart ..... A47F 7/0021 211/49.1
5,348,167 A * 9/1994 Jensen ..... A47F 5/0823 211/57.1
5,368,486 A * 11/1994 Kurzman ..... G09B 25/00 434/72
5,372,278 A * 12/1994 Leight ..... B65D 83/04 221/174
D355,586 S * 2/1995 Wang ..... D8/375
5,467,915 A * 11/1995 Mattson ..... A45C 13/26 215/396
5,503,278 A * 4/1996 Ishmael ..... A47F 7/0042 206/325
5,509,541 A * 4/1996 Merl ..... A47B 45/00 211/103
D372,816 S * 8/1996 Rose ..... D6/675.4
5,547,053 A * 8/1996 Liang ..... A45C 13/262 16/113.1
D377,144 S * 1/1997 Sawa ..... D9/432
D383,335 S * 9/1997 Shanahan ..... D20/19
5,675,936 A * 10/1997 Kurth ..... A47K 3/34 49/404
D392,820 S * 3/1998 Shanahan ..... D6/672
5,769,247 A * 6/1998 Merl ..... A47B 47/022 211/103
D396,805 S * 8/1998 Broyles ..... D9/432
5,822,810 A * 10/1998 Chen ..... A47K 3/362 4/610
5,823,339 A * 10/1998 Dunham ..... B65D 5/5009 206/349
5,848,446 A * 12/1998 DeBraal ..... A47K 3/34 4/607
5,860,526 A * 1/1999 Burke, Jr. ..... B65D 5/0227 206/446
D405,369 S * 2/1999 Dohner ..... D9/415
5,887,782 A * 3/1999 Mueller ..... B65D 5/0227 229/117
D409,858 S * 5/1999 Reed ..... D6/682.2
5,941,384 A * 8/1999 Schonhardt ..... B65D 5/5007 206/320
D417,978 S * 12/1999 Reed ..... D6/678.4
D425,972 S * 5/2000 Smale ..... D23/305
6,102,206 A * 8/2000 Pride ..... B65D 85/48 206/454
6,102,502 A * 8/2000 Melillo ..... A47B 57/06 211/41.16
6,105,796 A * 8/2000 Buchanan ..... A47F 9/04 186/59
6,170,675 B1 * 1/2001 Follman ..... A47B 81/068 211/189
6,182,738 B1 * 2/2001 Chen ..... A47K 3/362 160/199
6,250,044 B1 * 6/2001 Funk ..... A47K 10/10 211/105.2
D451,305 S * 12/2001 Chang ..... D6/672
D451,801 S * 12/2001 Schillinger ..... D9/418
6,340,092 B1 * 1/2002 McGrath, Jr. ..... A47F 7/0042 211/169
D454,067 S * 3/2002 Schoening ..... D9/719
6,389,991 B1 * 5/2002 Morrisson ..... A47B 57/585 108/61
D461,974 S * 8/2002 Hayden ..... D6/672
6,461,705 B2 * 10/2002 Eichhorn ..... B44C 1/14 428/13
6,467,856 B1 * 10/2002 Chang ..... A47F 5/10 211/134
6,484,890 B1 * 11/2002 Miller ..... A47F 7/0042 211/128.1
D466,804 S * 12/2002 Solland ..... D9/418
D469,349 S * 1/2003 Meeker ..... D9/418
6,594,973 B1 * 7/2003 Alpert ..... B65D 5/5035 125/9
D482,265 S * 11/2003 Wicha ..... D8/375
6,672,546 B2 * 1/2004 Calleja ..... A47F 5/01 248/58
6,681,445 B2 * 1/2004 Huang ..... E05D 15/0669 16/105
6,850,208 B1 * 2/2005 Ferrante ..... G06Q 10/087 345/1.1
D507,741 S * 7/2005 Lu ..... D9/418
6,913,151 B2 * 7/2005 Stevenson ..... B07C 7/02 209/630
6,935,514 B2 * 8/2005 Lackey ..... A47F 5/005 211/184
7,137,172 B2 * 11/2006 Elmer ..... E05D 15/063 16/105
7,150,361 B2 * 12/2006 Calleja ..... A47F 7/0021 211/49.1
7,178,681 B2 * 2/2007 Libman ..... A47F 5/0815 211/106
D548,066 S * 8/2007 Welch ..... D8/381
7,264,126 B1 * 9/2007 Bergeron ..... B65D 85/46 206/454
7,273,084 B2 * 9/2007 Chen ..... A47K 3/362 160/187
D556,031 S * 11/2007 Johnson ..... D8/381
D584,528 S * 1/2009 Neff ..... D6/702
D588,905 S * 3/2009 Meeks ..... D8/400
D593,409 S * 6/2009 Blick ..... D27/189
D594,742 S * 6/2009 Meier ..... D9/432
7,562,949 B1 * 7/2009 Nielsen ..... A47B 45/00 312/107
D600,110 S * 9/2009 Cain ..... D9/418
7,637,059 B2 * 12/2009 Chang ..... E05D 15/0634 16/102
D607,724 S * 1/2010 Dreier ..... D9/430
7,762,508 B2 * 7/2010 Xu ..... A47K 3/38 248/251
D622,083 S * 8/2010 Linder ..... D6/679
7,828,151 B2 * 11/2010 Murdoch ..... B65D 81/053 206/453
7,841,048 B2 * 11/2010 Tsai ..... E05D 15/063 16/107
7,900,784 B1 * 3/2011 Weigand ..... A47F 5/13 211/186
D639,652 S * 6/2011 Abdalkhani ..... D9/418
7,962,998 B2 * 6/2011 Proctor ..... E05D 15/063 16/106
D652,717 S * 1/2012 Shimoyama ..... B65D 5/18 D9/432
8,151,385 B2 * 4/2012 Goskowski ..... A47K 3/38 160/124
D660,988 S * 5/2012 Amend ..... D25/138
8,191,707 B2 * 6/2012 McDonald ..... B65D 5/0254 206/326
D668,540 S * 10/2012 Lutzig ..... D9/432
D685,260 S * 7/2013 Thielemier ..... D9/415
8,490,331 B2 * 7/2013 Quesada ..... E05D 15/0665 16/18 R

(56) References Cited

U.S. PATENT DOCUMENTS

D689,360 S * 9/2013 Adams ..... D9/418
D690,592 S * 10/2013 Ding ..... D9/432
D690,593 S * 10/2013 Kaps ..... D9/418
D694,099 S * 11/2013 Ensslen, III ..... D9/418
D699,563 S * 2/2014 McAdam ..... D9/418
8,707,475 B2 * 4/2014 Johnson ..... A47K 3/30 4/557
D706,626 S * 6/2014 Lazar ..... D9/432
D709,363 S * 7/2014 Boehnen ..... D9/418
8,789,899 B2 * 7/2014 Pirro ..... A47F 5/137 312/202
D710,713 S * 8/2014 Fath ..... D9/721
8,915,381 B2 * 12/2014 Brozak ..... A47F 7/0021 108/61
D729,055 S * 5/2015 Lemnios ..... D9/418
9,108,775 B2 * 8/2015 Savakus ..... B65D 57/00
D739,726 S * 9/2015 Lemnios ..... D9/432
D758,771 S * 6/2016 Austin, III ..... D6/683.1
D759,407 S * 6/2016 Denby ..... D6/675.2
D763,023 S * 8/2016 Austin, III ..... D6/683.1
D767,380 S * 9/2016 Austin, III ..... D8/375
9,434,524 B2 * 9/2016 Kindig ..... B65D 81/053
D777,018 S * 1/2017 Boehnen ..... D8/381
D777,564 S * 1/2017 Boehnen ..... D8/381
9,676,543 B2 * 6/2017 Lemnios ..... B65D 85/48
D791,519 S * 7/2017 Jordan ..... D6/678
9,743,810 B2 * 8/2017 Schultz ..... E05D 15/0621
9,907,415 B2 * 3/2018 Boehnen ..... A47F 7/0014
10,413,094 B2 * 9/2019 Boehnen ..... A47F 7/0014
2001/0002660 A1 * 6/2001 Riga ..... A47F 7/30 211/85.16
2001/0054258 A1 * 12/2001 Becken ..... E05D 15/0669 49/409
2002/0134030 A1 * 9/2002 Conway ..... A47F 5/0087 52/27
2002/0144375 A1 * 10/2002 Drucker ..... A45C 5/14 16/18 R
2002/0157318 A1 * 10/2002 Teubert ..... A47K 3/30 49/360
2003/0019982 A1 * 1/2003 Wing ..... B60B 1/006 248/188.8
2003/0047528 A1 * 3/2003 Stein ..... A47F 5/02 211/169
2003/0189018 A1 * 10/2003 Hopkins ..... A47F 5/0056 211/90.02
2004/0177437 A1 * 9/2004 Perry ..... A47K 3/34 4/557
2004/0238465 A1 * 12/2004 Mercure ..... A47B 81/00 211/41.14
2004/0245195 A1 * 12/2004 Pride ..... B65D 25/101 211/41.14
2005/0115202 A1 * 6/2005 Mertz, II ..... B65B 11/58 53/399
2005/0115860 A1 * 6/2005 Mertz, II ..... B65D 5/324 206/521
2005/0236299 A1 * 10/2005 Weber ..... B65D 75/54 206/775
2006/0043032 A1 * 3/2006 McHugh ..... B65D 85/48 211/41.14
2006/0196838 A1 * 9/2006 Mercure ..... A47F 7/0042 211/41.1
2006/0208150 A1 * 9/2006 Elmer ..... E05D 15/0652 248/694
2007/0045204 A1 * 3/2007 Huard ..... B65D 85/48 211/41.14
2007/0295680 A1 * 12/2007 Budge ..... B65G 1/02 211/85.18
2008/0073469 A1 * 3/2008 Mushan ..... H05K 7/1489 248/205.1
2008/0148639 A1 * 6/2008 Jakob-Bamberg ..... E05D 15/0634 49/130
2008/0148692 A1 * 6/2008 Wisecarver ..... B65D 5/5021 53/462
2008/0277363 A1 * 11/2008 McDonough ..... A47B 63/00 211/189
2009/0115299 A1 * 5/2009 Ricereto ..... A47B 67/04 312/330.1
2010/0107497 A1 * 5/2010 Hulst ..... E05D 5/06 49/162
2010/0181267 A1 * 7/2010 Theisen ..... A47F 7/0042 211/45
2010/0264058 A1 * 10/2010 Krause ..... B65B 5/024 206/745
2011/0035871 A1 * 2/2011 Seymour ..... A47K 3/006 4/556
2011/0113547 A1 * 5/2011 O'Connell ..... A47K 3/38 4/608
2012/0005822 A1 * 1/2012 Daubmann ..... A47K 3/34 4/607
2012/0036628 A1 * 2/2012 O'Connell ..... A47K 3/38 4/610
2012/0233926 A1 * 9/2012 Chang ..... E05D 15/063 49/358
2012/0259743 A1 * 10/2012 Pate, Jr. ..... G06Q 30/00 705/27.2
2013/0093298 A1 * 4/2013 Ehmke ..... A47F 3/00 312/204
2013/0140319 A1 * 6/2013 Tam ..... B65D 81/058 220/694
2013/0161276 A1 * 6/2013 Breeden ..... G09F 21/04 211/60.1
2013/0325670 A1 * 12/2013 Austin, III ..... G06Q 30/06 705/27.1
2014/0032447 A1 * 1/2014 Fisher ..... A47F 7/0021 705/500
2014/0173990 A1 * 6/2014 Schachter ..... E05F 5/003 49/404
2014/0237715 A1 * 8/2014 Wei ..... A47K 3/30 4/607
2014/0250795 A1 * 9/2014 Wei ..... A47K 3/30 49/505
2014/0259363 A1 * 9/2014 Ball ..... A47K 3/34 4/607
2014/0290001 A1 * 10/2014 Hasegawa ..... B62B 5/0086 16/45
2014/0319988 A1 * 10/2014 Dietz ..... A47F 5/0087 312/326
2014/0331564 A1 * 11/2014 Wei ..... A47K 3/30 49/505
2015/0096117 A1 * 4/2015 Forrest ..... A47K 3/38 4/610
2015/0208875 A1 * 7/2015 Austin, III ..... A47F 7/0042 4/607
2015/0210113 A1 * 7/2015 Yang ..... B60B 33/0044 16/47

FOREIGN PATENT DOCUMENTS

CN 204326804 U 5/2015
CN 204370961 U 6/2015
DE 2149016 4/1973
DE 9306878 U1 9/1993
DE 202009004111 U1 8/2009
EP 1020154 A2 7/2000
EP 2317052 A2 5/2011
EP 2774519 A1 9/2014
GB 827312 2/1960
JP 2001095657 A 4/2001
JP 2003237846 A 8/2003
WO 2005035396 A2 4/2005
WO 2005035396 A3 4/2005
WO 20080276224 A1 6/2008

(56) References Cited

FOREIGN PATENT DOCUMENTS

| | | | |
|---|---|---|---|
| WO | 2008133531 | A1 | 11/2008 |
| WO | 2009029358 | A1 | 3/2009 |

OTHER PUBLICATIONS http://www.johnsonhardware.com/doordisplay.htm, "Johnson Hardware Door Panel Display Unit", Dec. 16, 2010, 2 pages.
Quality Craft, "Installation Manual Shower Unit", Model No. 961WUX006WHI, Mar. 9, 2011, 14 pages.
HouseImprovements, Video: "How to Install Glass Sliding Shower Doors", Oct. 4, 2012, https://www.youtube.com/watch?v=u88j284_jAk, 32:25.

* cited by examiner

ARTICLE DIVIDER ASSEMBLY

CROSS-REFERENCE TO RELATED APPLICATIONS

This application is a continuation of U.S. application Ser. No. 15/875,247 filed Jan. 19, 2018, now U.S. Pat. No. 10,413,094 B2, which is a division of U.S. application Ser. No. 14/656,848 filed Mar. 13, 2015, now U.S. Pat. No. 9,907,415 B2, the disclosures of which are hereby incorporated in their entirety by reference herein.

TECHNICAL FIELD

Various embodiments relate to article divider assemblies for retail displays of articles.

BACKGROUND

Retail displays of shower door assemblies are disclosed in U.S. Patent Application Publication 2013/0325670 A1, which published to Austin, III et al. on Dec. 5, 2013.

SUMMARY

According to at least one embodiment, an article divider assembly is provided with a support bracket adapted to be mounted to a retail display. A divider member extends from the support bracket and is sized to extend between a pair of articles at an upper region of the pair of articles to divide the articles without blocking an outward face of the articles.

According to another embodiment, a retail display is provided with a frame. An article divider assembly is provided with a support bracket mounted to the frame. A divider member extends from the support bracket and is sized to extend between a pair of articles at an upper region of the pair of articles to divide the articles without blocking an outward face of the articles. At least one article is provided in the display adjacent to the divider member.

According to at least another embodiment, an article divider assembly is provided with a support bracket adapted to be mounted to a retail display. A divider member extends from the support bracket and is sized to extend between a pair of articles at an upper region of the pair of articles to divide the articles. The divider member comprises a proximal end mounted to the support bracket and a distal end extending away from the support bracket. A display bracket is mounted to the distal end of the divider member.

According to at least one embodiment, a method for displaying an article provides an article divider assembly with a support bracket mounted to a retail display, and a plurality of divider members extending from the support bracket. An article is provided in the display with an upper region of the article between a pair of divider members without blocking an outward face of the article.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Conventional shower door assemblies were retailed preassembled, which resulted in limited design choice combinations, and large packaged assemblies. U.S. Patent Application Publication 2013/0325670 A1, which published to Austin, III et al. on Dec. 5, 2013 discloses a retail display for shower door assemblies, wherein shower door assemblies are retailed in individually packaged components. The individual components may include glass panels, frames, lineals and hardware.

Figure 1:
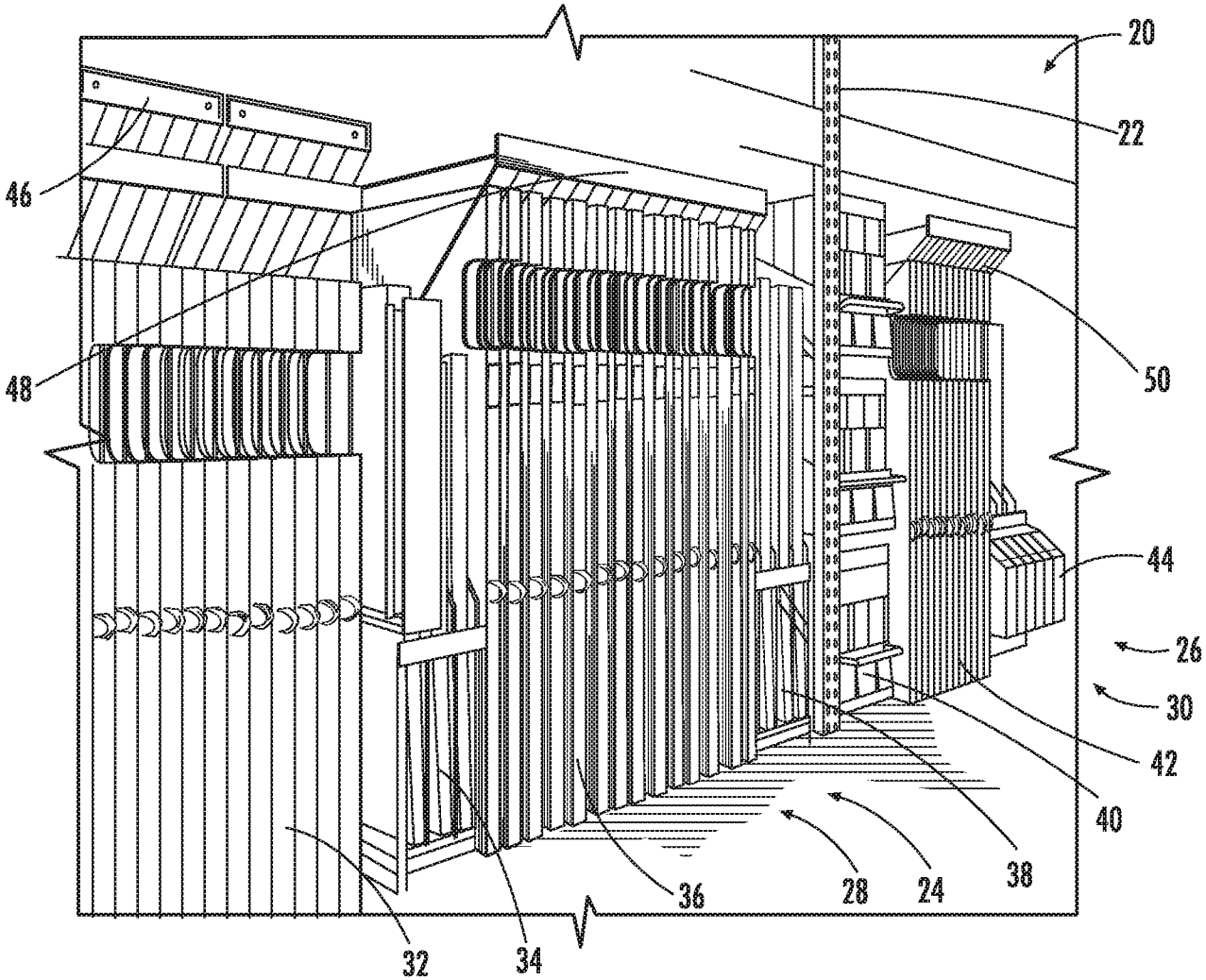
FIG. 1 is a front perspective view of a retail display according to an embodiment, with a plurality of article divider assemblies according to embodiments for dividing retail articles.

FIG. 1 illustrates a retail display system according to an embodiment and referenced generally by numeral 20. The retail display system 20 includes a frame 22, which may be a conventional point-of-sale frame 22 for displaying retail articles. The frame 22 defines multiple bays, such as bays 24, 26 as depicted for displaying shower door assembly components. The retail display system 20 is provided by, for example, a pair of retail shower door display assemblies 28, 30. The display system 20 is sized to be displayed within a retail store aisle, such as a home improvement store. The display system 20 is utilized for both displaying and retailing shower door components. The frame 22 sized to be received within a retail store aisle; and may be sized the same as conventional shelving for preassembled doors for easy replacement.

Shower door assemblies are conventionally categorized by function or type. For example, shower door assemblies include sliding shower door assemblies 28, which are depicted in the first bay 24 and pivoting shower door assemblies 30, which are depicted in the second bay 26. The first decision a consumer of shower door assemblies may need to decide is which style or category 28, 30 of shower door assembly is desired. Once the consumer selects a category 28, 30 the consumer may approach the corresponding bay 24, 26.

The sliding shower door assembly 28 includes an array of articles or shower door glass panes 32, which may be for sliding tub doors, for example. The shower door glass panes 32 may vary in style. The shower door glass panes 32 each have a standard height, a standard thickness, and a standard width for that application. An array of shower door tracks 34 is provided in the retail display system 20 with standard dimensions for the sliding tub door application. The tracks 34 may also vary in style. The separate packaging permits the customer to select from a large combination of varieties due to the interchangeability of the glass panes 32 and the tracks 34. The tracks 34 depicted may be guide tracks 34 for sliding a pair of shower door glass panes 32 within the guide tracks 34. Alternatively to, or in addition to, the tracks 34 may be frames for the shower door glass panes 32.

The sliding shower door assemblies 28 also include an array of shower door glass panes 36 for sliding shower doors. The shower door glass panes 36 include a standard height, which is typically greater than that for a sliding tub door. The shower door glass panes 36 have a standard thickness, and a standard width, for example, to span up to a forty-eight inch shower door opening.

The sliding shower door assemblies 28 include an array of shower door tracks 38 for the sliding shower door panes 36. Next, an array of shower door hardware 40 is oriented within the second bay 26 of the retail display system 20.

The retail display system 20 also includes an array of shower door glass panes 42 for pivoting shower door assemblies 30. An array of shower tracks and hardware 44 for the pivoting shower door assemblies 30 are also provided.

The retail shower door display system 20 provides a large variation of shower door assemblies 28, 30 without limits provided in prepackaged assemblies. The retail shower door display system 20 allows the consumer to custom configure a shower door based on the consumer's selection. The retail shower door display system 20 enables the consumer to mix and match style, finish, and glass textures for a customized sliding-tub shower door assembly 28, sliding shower door assembly 28 or a pivot shower door assembly 30. The retail shower door display system 20 permits the manufacturer to retail more Stock Keeping Units (SKUs) in the retail shower door display system 20 than would be practical with traditional preassembled and prepackaged shower door assemblies. The consumer can avoid having to lift, carry and transport a single total weight package due to the separation of the components. Consumers can also more readily transport components in vehicles due to an ability to place each packaged component in a vehicle interior and trunk due to separate packaging. Also, the customer can purchase replacement parts without a need to replace an entire shower door assembly in case of component repair when a specific component requires replacement, but the entire assembly does not require replacement. The customer can purchase replacement parts for new remodeling efforts where a glass or frame finish change is desired. The customer can purchase replacement parts for future product maintenance when one or more components require replacement due to wear or damage.

The manufacturer can also avoid steps of shipping the components to a common facility for assembling and packaging. The manufacturer can also more readily maintain inventory; easily add new products to the retail shower door display system 20; and regionalize the product mix.

Conventional preassembled shower door assemblies included packaging with a greater footprint than the packaging of the shower door glass panes 32, 36, 42. The prepackaged, preassembled shower door assemblies had a substantial footprint that was sufficient for supporting the weight of the package and its components. The modularity provided in the retail display system results in packages that have a much thinner footprint, which may result in leaning of one or more articles, such as shower door glass panes 32, 36, 42. As multiple articles lean, the cumulative weight may result in much difficulty in removing one or more articles 32, 36, 42. To prevent the leaning of articles, a plurality of article divider assemblies 46, 48, 50 are mounted to the frame 22 to manage the weight of the articles 32, 36, 42. The article divider assemblies 46, 48, 50 may each individually contact or receive the articles 32, 36, 42 at an upper region of the article 32, 36, 42, above the center of gravity so that the articles 32, 36, 42 stay in place with minimal mechanical effort.

Figure 2:
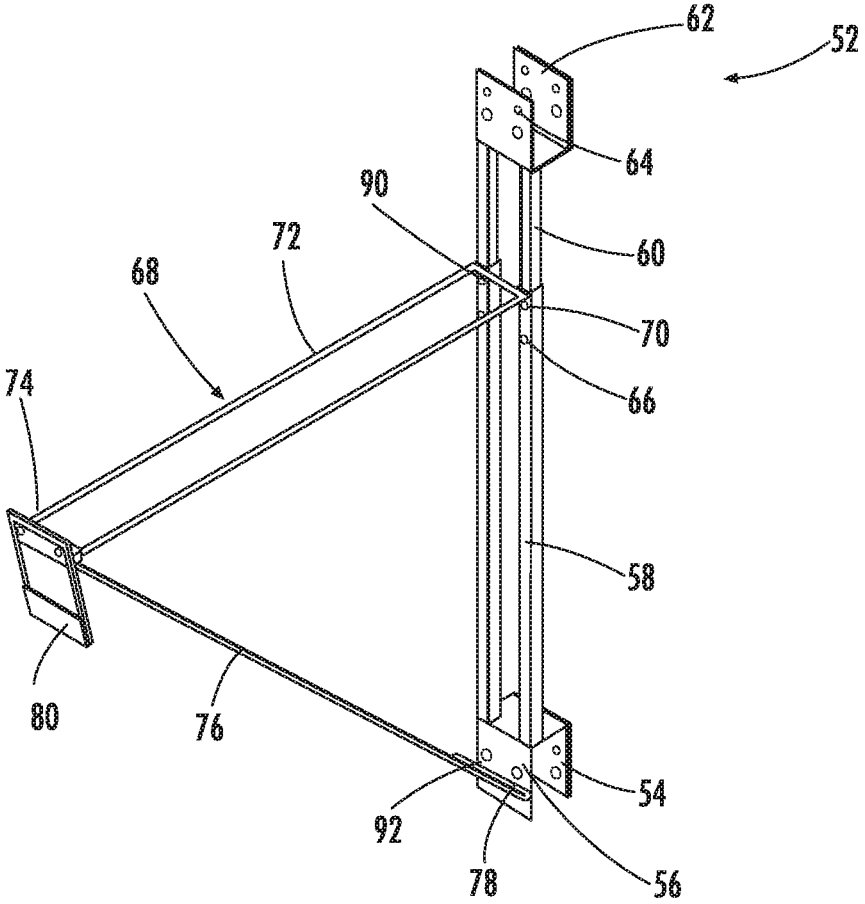
FIG. 2 is a perspective view of an article divider assembly according to an embodiment.
Figure 4:
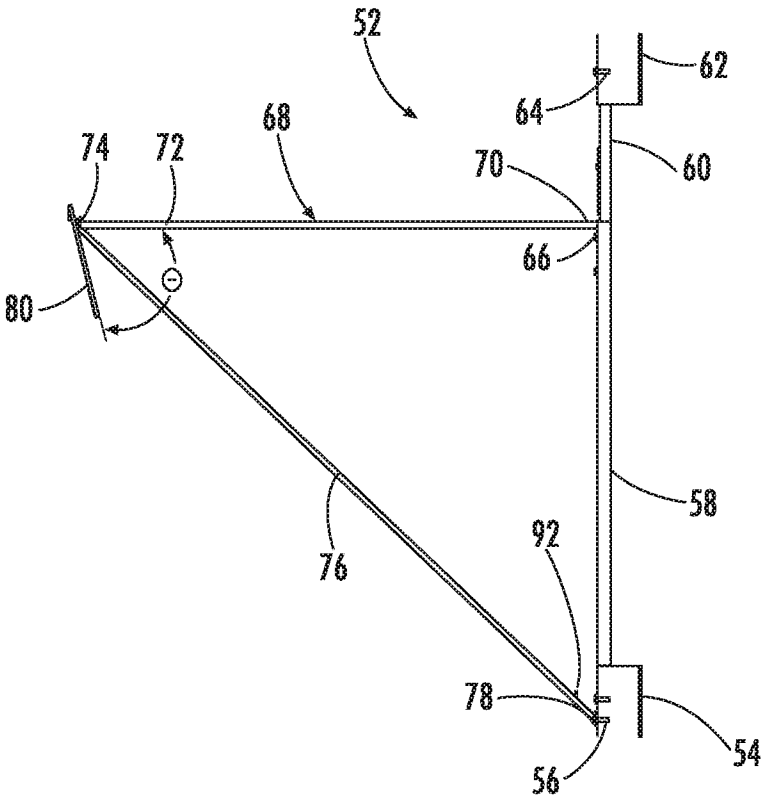
FIG. 4 is a right side elevation view of the article divider assembly of FIG. 2.
Figure 3:
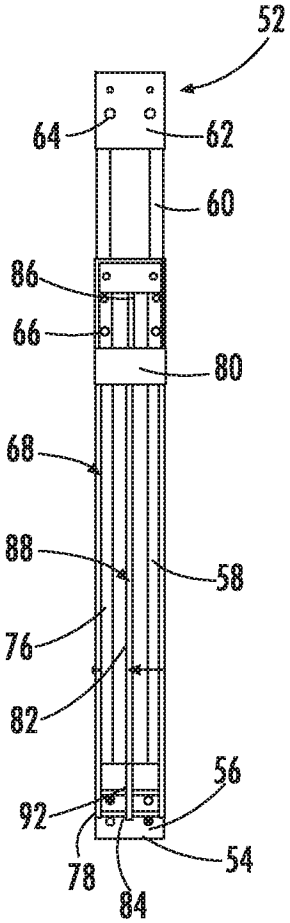
FIG. 3 is a front elevation view of the article divider assembly of FIG. 2.

FIGS. 2-4 illustrate an article divider assembly 52 according to an embodiment, which may be employed as any of the article divider assemblies 46, 48, 50 in the retail display system 20 of the prior embodiment. The article divider assembly 52 has a lower support bracket 54 that is sized to receive a cross member of the frame 22 for mounting the article divider assembly 52 to the frame 22. The lower support bracket 54 includes a fastener configuration 56 to match a corresponding fastener configuration in the cross member of the frame 22. A pair of sleeves 58 extend upright from the lower support bracket 54. A pair of posts 60 is received in the sleeves 58 for translation relative to the sleeves 58. An upper support bracket 62 is mounted to the pair of posts 60 and is also sized to receive another cross member of the frame 22. The upper support bracket 62 is adjustable relative to the lower support bracket 54 for expanding to receive a pair of cross members of the frame 22 and for accommodating various beam spacing in frames 22. The upper support bracket 62 also includes a fastener configuration 64 for securing the upper support bracket 62 the frame 22. A fastener configuration 66 is provided engaging the sleeves 58 and the posts 60 for securing the posts 60 relative to the sleeves 58 at an adjusted height.

The article divider assembly 52 includes two divider members 68 for dividing the articles. Each divider member 68 has an upper proximal end 70 mounted to the sleeves 58. A horizontal bar 72 extends forward from the upper proximal end and away from the sleeves 58 to a distal end 74. An angled bar of each article divider member 68 extends to the lower support bracket 54 at a lower proximal end 78. Each divider member 68 may formed from a heavy wire, such as a quarter inch diameter wire, which may be welded at each connection for forming the article divider assembly 52.

A stabilizer bracket 80 is mounted to the distal ends 74 of the divider members 68 to maintain a spacing between the divider members 68. As illustrated in FIG. 3, an intermediate angled bar 82 is provided between the angled bars 76 of the divider members 68. The intermediate angled bar 82 is mounted to the lower support bracket 54 at a proximal end 84, and to the stabilizer bracket 80 at a distal end 86. The intermediate angled bar 82 provides a third divider member 88.

The article divider members 68, 88 are incrementally spaced apart a distance to receive an article, in other words a distance that is greater than a thickness of the article, but less than a thickness of two articles to prevent receipt of more than one article. The article divider members 68, 88 provide lateral support only to the received articles, and do not contact or block an outward facing surface of the article so that a user may merely slide an article into or out of the article divider assembly 52, and consequently the retail display system 20. The stabilizer bracket 80 is oriented spaced above a top surface of the articles for clearance of the articles relative to the stabilizer bracket 80.

A rod 90 is welded to the upper proximal ends 70 of the horizontal bars 72 to add rigidity and maintain spacing.

Another rod 92 is welded to the angled bars 76, 82 to add rigidity, and maintain spacing. The lower rod 92 sets a limit for receipt of articles and prevents the articles from being pushed too far into the display system 20.

The stabilizer bracket 80 also functions as a display bracket for receipt of indicia indicative of information regarding a corresponding article. In other words, the stabilizer bracket 80 is sized and shaped for receipt of price stickers. Typically, price stickers are provided on an upper cross member of the frame 22, which may be multiple feet above the associated article, which may lead to confusion associating a price sticker with an article. The stabilizer/display bracket 80 is oriented directly above the article for convenience of the retailer and the purchaser. The stabilizer/display bracket 80 provides an acute angle θ, such as seventy-five degrees, relative to the horizontal bars 72 so that an outward face is angled downward for improving a viewing angle of the retailer and customer.

By holding the articles individually upright as assisted by the article divider assembly 52, a store associate can more readily determine quantities of stocked products for various styles for restocking and or reordering.

Figure 6:
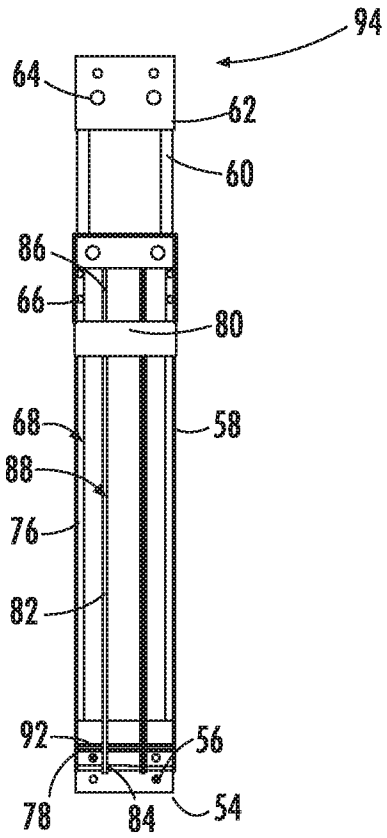
FIG. 6 is a front elevation view of the article divider assembly of FIG. 5.
Figure 5:
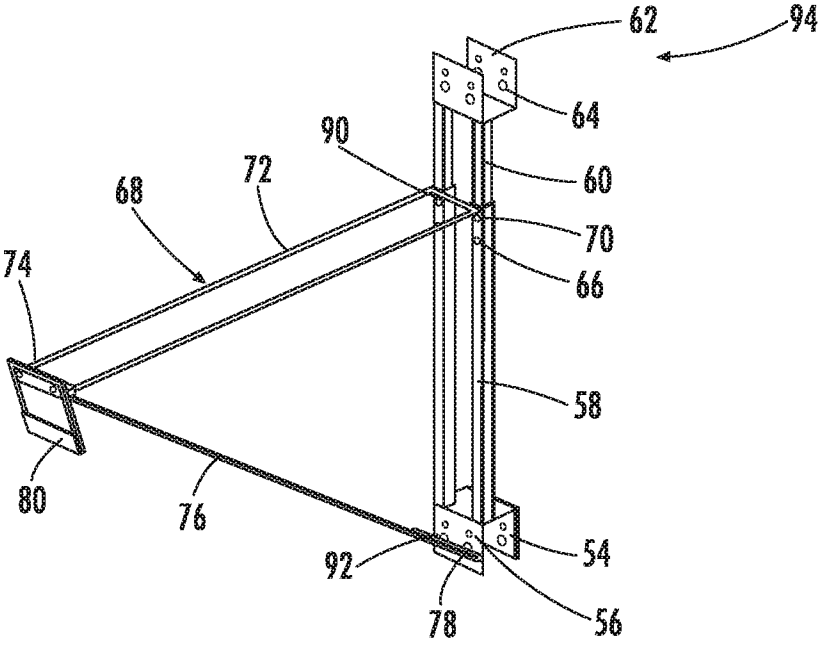
FIG. 5 is a perspective view of an article divider assembly according to another embodiment.
Figure 8:
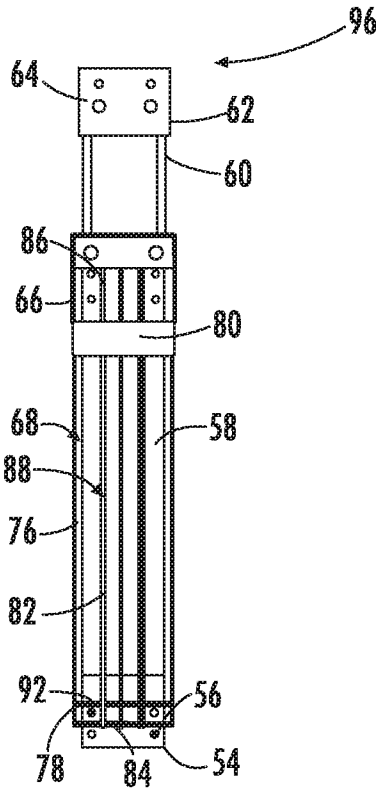
FIG. 8 is a front elevation view of the article divider assembly of FIG. 7.
Figure 7:
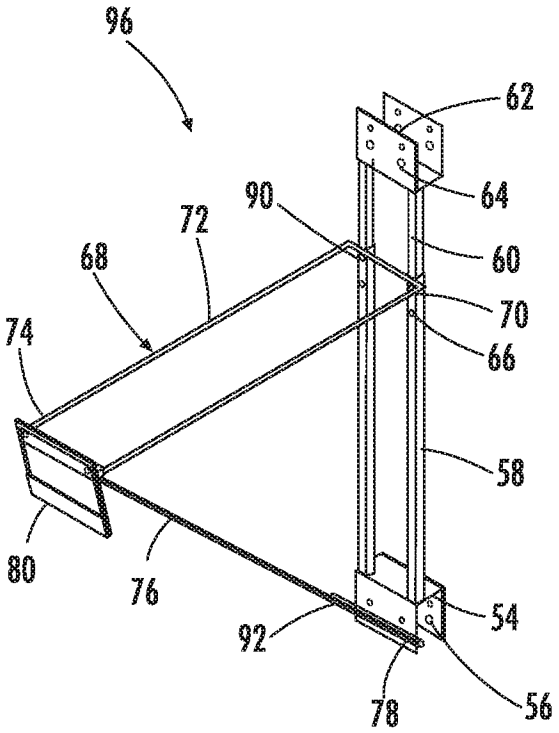
FIG. 7 is a perspective view of an article divider assembly according to another embodiment.

FIGS. 5 and 6 illustrate an article divider assembly 94 according to another embodiment. The article divider assembly 94 is similar to the prior embodiment and like elements retain like reference numerals. In contrast, the article divider assembly 94 is wider with two intermediate angled bars 82. Similarly, FIGS. 7 and 8 illustrate an article divider assembly 96 according to yet another embodiment with three intermediate angled bars 82. The various embodiments depict that the article divider assemblies 52, 94, 96 are scalable for any number of divider members 68, 88 as a display may require.

Figure 9:
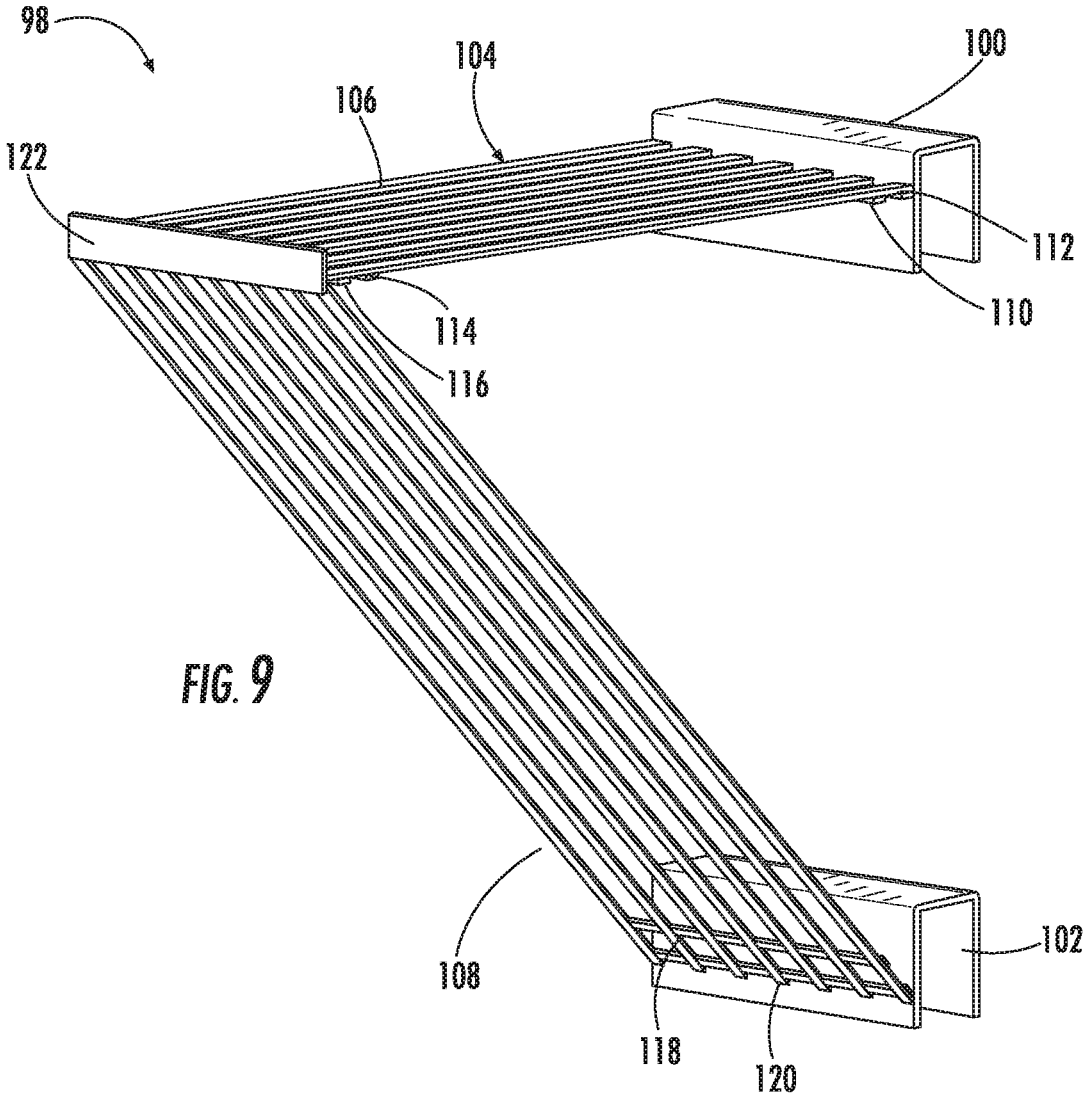
FIG. 9 is a perspective view of an article divider assembly according to another embodiment.
Figure 10:
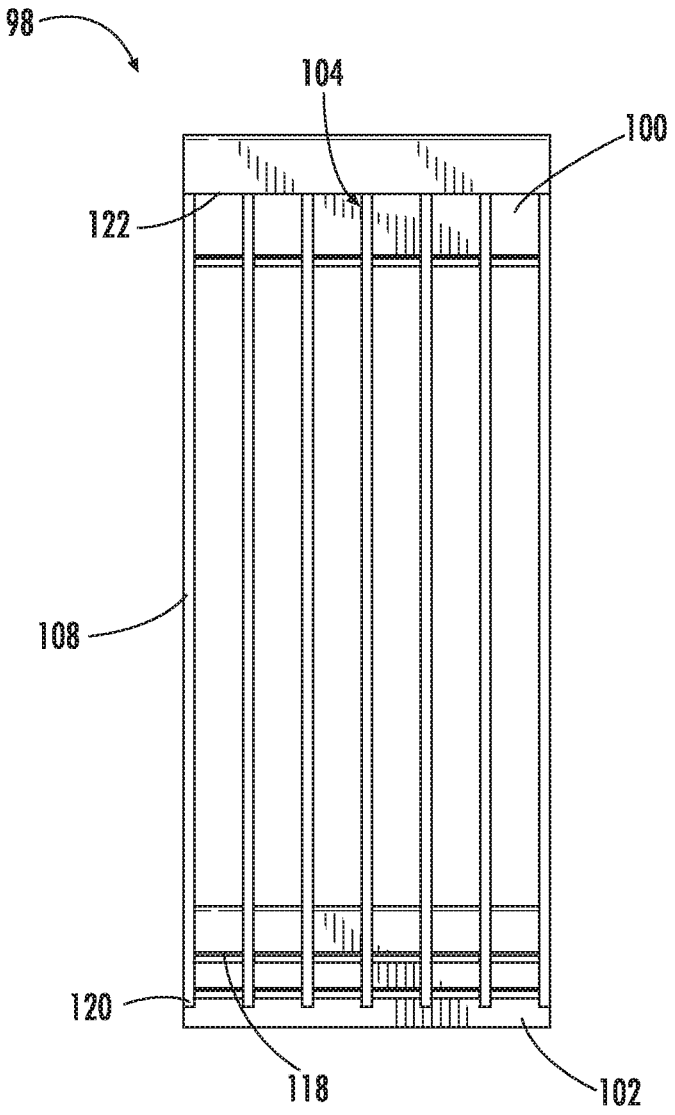
FIG. 10 is a front elevation view of the article divider assembly of FIG. 9.

FIGS. 9 and 10 illustrate an article divider assembly 98 according to yet another embodiment. The article divider assembly 98 is similar to the prior embodiments but is simplified without adjustability. Upper and lower support brackets 100, 102 are both open downward to be concurrently installed onto a pair of cross members of the frame. The article divider assembly 98 includes a plurality of divider members 104 that each include a horizontal bar 106 and an angled bar 108. A pair of rods 110 is provided on the horizontal bars 106 adjacent an upper proximal end of the divider members 104 for spacing and support. Another pair of rods 114 is provided at a distal end 116 of the divider members 104. A lower pair of rods 118 is provided at a lower proximal end 120 of the divider members 104. A stabilizer/display bracket 122 is provided at the distal ends 116 of the divider members 104.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A retail display comprising:

a frame;

a plurality of article divider assemblies mounted to the frame, the plurality of article divider assemblies each comprising:

a support bracket mounted to the frame, a divider member extending from the support bracket and sized to extend between a pair of articles at an upper region of the pair of articles to divide the pair of articles without blocking an outward face of the pair of articles, wherein the divider member comprises a plurality of incrementally spaced divider members extending from the support bracket, wherein the divider member comprises a proximal end mounted to the support bracket and a distal end extending away from the support bracket, and a display bracket mounted to the distal end of the divider member, wherein the display bracket is angled relative to the divider member to face downward; and a plurality of articles provided in the display, each adjacent to one of the plurality of divider members to prevent each of the plurality of articles from leaning on an adjacent article of the plurality of articles.

2. The retail display of claim 1 wherein each of the plurality of incrementally spaced divider members is spaced apart a distance that is greater than a thickness of one of the plurality of articles.

3. The retail display of claim 2 wherein each of the plurality of incrementally spaced divider members is spaced apart the distance that is less than a combined thickness of a pair of the plurality of articles.

4. The retail display of claim 1 wherein the article each article divider assembly further comprises a stabilizer bracket mounted to the distal ends of the plurality of incrementally spaced divider members.

5. The retail display of claim 1 wherein each support bracket comprises an upper support bracket and a lower support bracket; and wherein each divider member extends from the upper support bracket and the lower support bracket.

6. The retail display of claim 5 wherein at least one of the upper support bracket and the lower support bracket is adjustable relative to the other.

7. The retail display of claim 1 wherein indicia indicative of article information is provided on each display bracket.

8. The retail display of claim 1 wherein the display bracket is oriented above an upper height of the plurality of articles for clearance of the plurality of articles.

9. The retail display of claim 1 wherein the divider member is provided above a center of gravity of the plurality of articles.

10. The retail display of claim 1 wherein the plurality of articles comprises a plurality of shower door components.

11. The retail display of claim 1 wherein the plurality of articles further comprises a plurality of panes.

12. The retail display of claim 1 wherein the plurality of article divider assemblies do not block the outward face of the articles to permit each of the plurality of article to be slid out of the frame.

13. A retail display comprising:

a frame;

a plurality of article divider assemblies mounted to the frame, the plurality of article divider assemblies each comprising:

a support bracket mounted to the frame, a divider member extending from the support bracket and sized to extend between a pair of article panes at an upper region of the pair of article panes to divide the pair of article panes without blocking an outward face of the pair of article panes to permit each of the pair of article panes to be slid out of the frame, wherein the divider member comprises a plurality of incrementally spaced divider members extending from the support bracket, wherein the divider member comprises a proximal end mounted to the support bracket and a distal end extending away from the support bracket, and a display bracket mounted to the distal end of the divider member, wherein the display bracket is angled relative to the divider member to face downward; and a plurality of article panes provided in the display, each adjacent to one of the plurality of divider members.

14. The retail display of claim 13 wherein each of the plurality of incrementally spaced divider members is spaced apart a distance that is greater than a thickness of one of the plurality of article panes; and wherein each of the plurality of incrementally spaced divider members is spaced apart the distance that is less than a combined thickness of a pair of the plurality of article panes.

15. The retail display of claim 13 wherein each article divider assembly further comprises a stabilizer bracket mounted to the distal ends of the plurality of incrementally spaced divider members.

16. The retail display of claim 13 wherein each support bracket comprises an upper support bracket and a lower support bracket;

wherein each divider member extends from the upper support bracket and the lower support bracket; and wherein at least one of the upper support bracket and the lower support bracket is adjustable relative to the other.

17. The retail display of claim 13 wherein indicia indicative of article information is provided on each display bracket.

18. The retail display of claim 13 wherein the display bracket is oriented above an upper height of the plurality of article panes for clearance of the plurality of article panes.

19. The retail display of claim 13 wherein the divider member is provided above a center of gravity of the plurality of article panes.

20. The retail display of claim 13 wherein the plurality of article panes comprises a plurality of shower door panes.

* * * * *